US006967522B2

(12) United States Patent
Chandrakasan et al.

(10) Patent No.: US 6,967,522 B2
(45) Date of Patent: Nov. 22, 2005

(54) ADAPTIVE POWER SUPPLY AND SUBSTRATE CONTROL FOR ULTRA LOW POWER DIGITAL PROCESSORS USING TRIPLE WELL CONTROL

(75) Inventors: Anantha Chandrakasan, Belmont, MA (US); Masayuki Miyazaki, Tokyo (JP); James Kao, Austin, TX (US)

(73) Assignee: Massachusetts Institute of Technology, Cambridge, MA (US)

( * ) Notice: Subject to any disclaimer, the term of this patent is extended or adjusted under 35 U.S.C. 154(b) by 455 days.

(21) Appl. No.: 10/115,307

(22) Filed: Apr. 3, 2002

(65) Prior Publication Data

US 2004/0183588 A1 Sep. 23, 2004

Related U.S. Application Data

(60) Provisional application No. 60/284,324, filed on Apr. 17, 2001.

(51) Int. Cl.[7] ..... G05F 3/02
(52) U.S. Cl. ..... 327/534; 327/537
(58) Field of Search ..... 327/534, 537; 365/226–229

(56) References Cited

U.S. PATENT DOCUMENTS 5,557,231 A * 9/1996 Yamaguchi et al. ..... 327/534
5,610,533 A * 3/1997 Arimoto et al. ..... 326/33
5,874,851 A * 2/1999 Shiota ..... 327/537
6,232,827 B1 * 5/2001 De et al. ..... 327/537
6,380,798 B1 * 4/2002 Mizuno et al. ..... 327/534
6,417,726 B1 * 7/2002 Kitade ..... 327/543
6,448,840 B2 9/2002 Kao et al. ..... 327/534
6,472,916 B2 * 10/2002 Mizuno et al. ..... 327/158
6,559,708 B2 * 5/2003 Notani ..... 327/537
6,744,301 B1 * 6/2004 Tschanz et al. ..... 327/534
6,774,705 B2 * 8/2004 Miyazaki et al. ..... 327/534

OTHER PUBLICATIONS

Gutnik, et al., "An Efficient Controller for Variable Supply-Voltage Low Power Processing," 1996 Symposium on VLSI Circuits Technical Digest, pp. 158-159.
Miyazaki, A delay distribution squeezing scheme with speed-adaptive threshold-voltage CMOS for low voltage LSIs.'ISLPED'98 (International Symposium on Low Power Electronics and Design), pp. 48-53, 1998.
Burd, "A Dynamic Voltage Scaled Microprocessor System," OSSCC Technical Digest, pp. 1571-1583, Feb. 2000.
Gonzalez, "Supply and Threshold Voltage Scaling for Low Power CMOS," JSSC, pp. 1210-1216, Aug. 1997.
Kaenel, "Automatic Adjustment of Threshold and Supply Voltages for Minimum Power Consumption in CMOS Digital Circuits," pp. 78-79, ISLPED 1994.

* cited by examiner

*Primary Examiner*—Terry D. Cunningham

(57) ABSTRACT

A system for improving the power efficiency of an electronic device includes a threshold voltage selector and a supply voltage selector. The threshold voltage selector selects a value of a threshold voltage for operation of the device in response to a present operating condition of the device. The supply voltage selector selects a value of a supply voltage to be applied to the device in response to the present operating condition of the device. The value of the threshold voltage and the value of the supply voltage control a power consumption of the device.

37 Claims, 14 Drawing Sheets

ADAPTIVE POWER SUPPLY AND SUBSTRATE CONTROL FOR ULTRA LOW POWER DIGITAL PROCESSORS USING TRIPLE WELL CONTROL

RELATED APPLICATIONS

This application claims the benefit of the filing date of co-pending U.S. Provisional Application, Ser. No. 60/284,324, filed Apr. 17, 2001, entitled "Adaptive Power Supply and Substrate Control for Ultra Low Power Digital Processors Using Triple Well Control," the entirety of which provisional application is incorporated by reference herein.

GOVERNMENT SUPPORT

This invention was made with government support under Contract Number F30602-00-2-0551, awarded by the U.S. Air Force. The government has certain rights in the invention.

FIELD OF THE INVENTION

The invention relates to electronic components in general and, more specifically, to optimization of power utilization by digital integrated circuits.

BACKGROUND OF THE INVENTION

Power consumption is a significant limitation on the utility of many electronic devices. Portable devices rely on battery power or other portable power sources. Batteries, for example, add significant weight to a portable device and have limited power storage capacity. Hence, greater power consumption by a device typically either creates a demand for larger batteries or leads to shorter battery lifetime.

Several approaches exist for the reduction of power consumption in portable devices. For example, components can be carefully selected for the demands of a particular device so that no more power is consumed than needed. Further, electronic circuits may utilize low-power design features. Alternatively, electronic circuits can be designed to vary their power consumption. For example, microprocessors can be designed to vary their operational frequency as the processing demand on the device varies.

Reduction of transistor feature sizes is a standard approach to the reduction of power consumption in digital integrated circuits. Reduction of transistor feature dimensions, for example, the gate length, permits use of lower supply voltages, and leads to reduced power consumption.

As feature sizes and supply voltage scale downward, lower threshold voltages, i.e., switching voltages, are typically selected to maintain device performance. Device power consumption arises, in large part, due to dynamic switching and due to leakage currents. Hence, power efficient digital circuit designs have utilized the ability to reduce power consumption via thoughtful selection of transistor supply voltages and threshold voltages.

Dynamic power consumption arises from the charging and discharging of capacitances, and is proportional to the square of the supply voltage. Leakage power consumption arises from subthreshold leakage currents that occur when threshold voltages are so small that a device cannot turn off strongly. Leakage currents increase exponentially as the threshold voltage is reduced.

Historically, dynamic switching losses have dominated leakage losses. Hence, supply voltage scaling has been one of the most effective ways to reduce operating power. For applications that entail a variable operating frequency, Dynamic Voltage Scaling ("DVS") and frequency scaling have been used to reduce power consumption. The supply voltage is scaled while the computation time is extended as much as allowable by variations in the processing rate. In essence, frequency and power consumption are reduced with reduced processing rate demand, i.e., workload demand, to reduce overall device power consumption.

Leakage currents, however, place a lower limit on supply voltage scaling. Supply and threshold voltages are often selected to minimize idle mode power consumption, which arises from sub-threshold leakage. Adaptive substrate biasing has been used to provide reduced threshold voltage operation during active periods, and high threshold voltage operation during inactive periods. This use of adaptive substrate biasing can provide reduced overall power consumption due to leakage losses.

Nevertheless, achieving reduced total power consumption grows ever more challenging as new devices incorporate ever smaller integrated circuit design features.

SUMMARY OF THE INVENTION

The invention relates to a system for improving the power efficiency of an electronic device. In preferred embodiments, active power consumption is minimized by optimizing dynamic switching power and leakage power losses.

Features of the invention can be applied to a variety of devices, for example, an integrated circuit component, a collection of components or a complete apparatus. For example, a device may be a microprocessor, a cellular telephone or a portable computer. Further, a device may be a portion of a component, for example, a single transistor or a pair of transistors that form part of the component.

The system responds to one or more present operating conditions of a device, such as a present temperature or workload, to control power consumption of the device. The system may respond to gradual changes in device structure, for example, due to hot carrier effect, electromigration damage. By responding to a present condition, the system can, for example, improve power efficient device operation.

The invention is particularly suited to reduce power consumption in digital processors, in part through use of a triple-well transistor structure. An adaptive power supply and substrate bias controller may be used to control and reduce power consumption be selecting supply voltages and threshold voltages that are suited to varying operating conditions. For example, a digital signal processor ("DSP") can be dynamically adjusted during runtime to compensate for variations in workload requirements or temperature to ensure that the DSP operates with good power efficiency.

In a preferred embodiment, the system involves low power optimization of a digital circuit. The system cooperatively adjusts both a supply voltage and a threshold voltage, in response to a present operating condition of the digital circuit, to control power consumption. The system may involve measurements of preferred supply voltage and threshold voltages before device operation. Alternatively, the system may involve determination of preferred values of supply voltage and threshold voltage during device operation. In another alternative, the system may involve measurements taken before operation in combination with determinations made during operation.

The system may reduce power consumption by simultaneously controlling device threshold voltages and power supply voltages. The system may be applied to devices that include PMOS and NMOS transistors in a triple-well structure. The triple-well structure permits individual tuning of the threshold voltages of the PMOS and NMOS device bodies. The threshold voltages can be modified via the body effect.

The supply voltage may be provided via a variable rate switching regulator, which permits dynamic supply voltage adjustment during runtime, in concert with dynamic control of threshold voltages.

The invention involves implementation of two control loops: one to automatically adjust a body bias; and one to select supply voltage. Some embodiments of two control loops include a closed loop design, in which the supply voltage and the body bias are automatically adjusted, using an outside supply voltage controller and an internal substrate biasing loop. Other embodiments include lookup tables that provide predetermined values for supply voltage and threshold voltage, which can be selected in response to a present, runtime operating conditions. Still other embodiments entail a hybrid approach, which include both a lookup table, for example, for the supply voltage loop, and a delay locked feedback loop approach for adaptive body biasing.

According, in a first aspect, the invention features a system for improving the power efficiency of an electronic device. The system includes a threshold voltage selector, which selects a value of a threshold voltage. The device is operated at the selected value. The threshold voltage selector responds to a present operating condition of the device detected during operation of the device. The threshold voltage may be controlled by applying a body bias voltage to the device.

The system further includes a supply voltage selector that selects a value of a supply voltage to be applied to the device in response to the present operating condition of the device. The selected values of the threshold voltage and the supply voltage are used to control a power consumption of the device.

In one embodiment, the threshold voltage selector cooperates with the supply voltage selector by varying the threshold voltage while the supply voltage is fixed. In another embodiment, the supply voltage selector cooperates with the threshold voltage selector by varying the supply voltage while the threshold voltage is fixed. Thus, during operation of the device, the supply voltage and the threshold voltage are swept and/or incremented to determine, for example, a power consumption minimizing setting.

In one embodiment, the device includes pairs of PMOS and NMOS transistors. The threshold voltage selector respectively selects first and second values of the threshold voltage for the plurality of PMOS and the plurality of NMOS transistors. The supply voltage selector respectively selects first and second values of the supply voltage to be applied to the PMOS and the NMOS transistors.

The first value of the threshold voltage and the first value of the supply voltage are used to control a power consumption of the PMOS transistors. Similarly, the second value of the threshold voltage and the second value of the supply voltage are used to control the power consumption of the NMOS transistors. Each of the transistor pairs may have a triple-well structure.

In one embodiment, the system includes a present operating condition detector that measures the present operating condition of the device. The measured condition may be for example, the temperature, frequency or workload of the device. The device may be, for example, a microprocessor or other digital integrated circuit.

In a second aspect, the invention features a method of controlling power consumed by an electronic device. The method includes detecting a present operating condition of the device, and selecting values of a threshold voltage and a supply voltage in response to the present operating condition of the device. The threshold voltage and the supply voltage control a power consumption of the device.

BRIEF DESCRIPTION OF THE DRAWINGS

The invention is pointed out with particularity in the claims. The drawings are not necessarily to scale, emphasis instead generally being placed upon illustrating the principles of the invention. Like reference characters in the respective drawing figures indicate corresponding parts. The advantages of the invention described above, as well as further advantages of the invention, may be better understood by reference to the description taken in conjunction with the accompanying drawings, in which:

DETAILED DESCRIPTION

Figure 1:
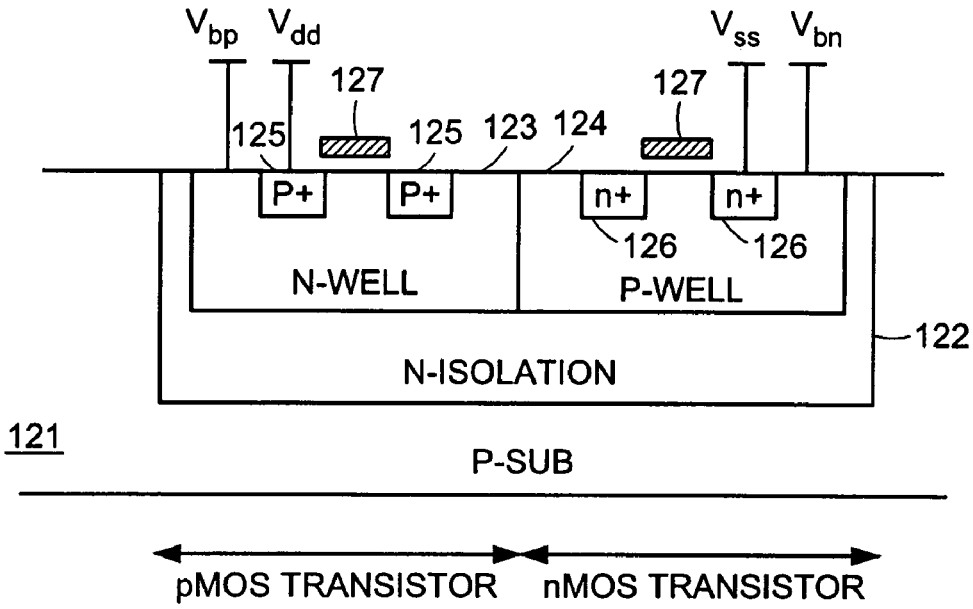
FIG. 1 is a cross-sectional view of an embodiment of a complementary metal-oxide semiconductor triple-well transistor structure.

Various embodiments entail systems and methods that can control power dissipation through simultaneous control of device thresholds and power supply voltages. Power dissipation may be reduced, for example, to extend the life of batteries that power the device. The invention may benefit a variety of devices, including, for example, a portion of an integrated circuit, a complete integrated circuit component, a collection of components or a complete apparatus. For example, devices that may benefit include microprocessors, cellular telephones, portable computers and a portion of a component, for example, a single transistor or a pair of transistors.

The systems and methods are particularly suited to devices that include integrated circuits having transistors. Such devices include, for example, digital-signal processors ("DSP"), low power microprocessors, microcontrollers and digital circuits in general. Systems and methods of the invention may be implemented via software and/or hardware. For example, some embodiments include static random access memory ("SRAM") or a read-only memory ("ROM") components.

In one embodiment, the operating power of a digital logic circuit is reduced by simultaneously controlling power supply voltage and threshold voltage during operation of the device. In preferred embodiments, a threshold voltage is controlled by applying a body bias voltage, e.g., a substrate bias voltage. These embodiments are particularly advantageous when employed in conjunction with devices that include complementary metal-oxide semiconductor ("CMOS") transistors having a triple-well structure. A given target operating frequency may have a corresponding minimal power dissipation point that provides a tradeoff between increased subthreshold voltage leakage currents and lower dynamic switching currents as supply voltage (Vdd) and threshold voltage (Vth) scale.

Throughout the following description, the expression "substrate bias voltage" generally refers to a voltage that is applied to a device via a contact at any of a variety of die locations. For example, a substrate bias voltage can be applied to via a contact to a backside of a die, or via a contact to a dopant well within which a device resides.

Some embodiments include control loops to control one or more supply voltages and/or one or more threshold voltages of pairs of transistors. A control loop controls a voltage in response to a present operating condition of the subject device. By responding to a present condition, the control loops permit, for example, reduction of power consumption. Thus, power consumption can be optimized relative, for example, to prior art methods that do not respond to present, variable operating conditions.

Control loops may be broadly categorized as being either open loop or closed loop. An open control loop utilizes measurements made prior to device operation to assist selection of a preferred voltage during device operation. A closed control loop varies the voltage adaptively during device operation to determine the preferred voltage.

In more detail, use of an open loop requires the determination of a correspondence between preferred voltages and operating condition values prior to device operation. The determinations can be made in a variety of ways including, for example, use of a test device, simulations, and measurements on the actual device. During operation of the device, the presently preferred voltages are then identified by the previously determined correspondence to a present operating condition value.

In some embodiments, temperature is the operating condition of interest. In one embodiment, a test device is operated over a range of temperatures, and a voltage is varied at several different temperatures to determine a preferred voltage at each temperature setting. Thus, for example, a correlation between power minimizing voltages and temperature are determined. The temperature/voltage correspondence data is stored for reference during actual operation of the device. During device operation, temperature is measured, and the voltage that corresponds to the presently measured temperature is selected for present operation of the device.

In contrast to an open control loop, a closed control loop does not utilize a predetermined correlation of preferred voltage to operating condition. Instead, an closed control loop varies the voltage of interest to determine a preferred operating condition, while a device is presently operating or during a pause in the present operation of the device. The preferred voltage is determined while the present operating condition exists. Thus, the present operating condition need not be measured.

Power dissipation may be reduced, for example, when processing rate requirements vary, i.e., workload demand varies, through dynamic adjustment of supply voltage (Vdd) and body bias voltage (Vbb). Forward body bias may be used to increase the dynamic range of device threshold. Forward biasing, however, may degrade performance because diode and parasitic-bipolar emitter currents in a substrate may dominate. Hence, an optimum power point may correspond to a forward body bias at which the operating speed can no longer be improved with increased forward bias.

In a closed control loop, the supply voltage or the threshold voltage may be determined during operation by varying a supply voltage or a threshold voltage, while observing the power consumption of the device. The observations may be performed on a monitor circuit, rather than on the device itself. In the former case, the supply voltage and/or threshold voltage may be determined prior to device operation by observations on the device, a prototype device or model circuit, for example. The predetermined values may then be stored for use by the device during operation. The predetermined values may be stored, for example, in a lookup table. A lookup table may be implemented via hardware and/or software components that provide permanent or temporary data storage.

Various embodiments implement a dual control loop to cooperatively select and apply a supply voltage and select and set a threshold voltage, and thus control a power dissipation. The following will describe several detailed embodiments that implement control loops for a CMOS device. These embodiments may be categorized as belonging to one of three control loop implementations: dual open loop; dual closed loop; and hybrid loop. These implementations may permit decoupling of supply voltage control and threshold voltage control, for more stable control of power consumption. A device may include voltage controllers, or voltage controllers may be located separately from the device.

A dual open loop approach utilizes, for example, a lookup table to provide preferred voltage values that correspond to a present operating condition of the device. A lookup table is populated with data determined prior to operation of the device.

A dual closed loop approach preferably utilizes automatic adjustments made during operation of the device to select a preferred voltage, for example, a supply or threshold voltage.

A hybrid approach is a mixture of the two approaches. For example, a hybrid approach may use a lookup table for an open supply voltage control loop, and use a closed delay locked feedback loop for adaptive biasing to automatically select and control the threshold voltage.

FIG. 1 illustrates an embodiment of a CMOS triple well transistor structure. The methods and systems of the invention are preferably utilized to control power consumption by devices that include one or more such transistor structures.

The transistors are formed on a p-type silicon substrate 121. Two transistors, one PMOS and one NMOS, reside in an n-type isolation well 122. The PMOS transistor includes an n-type well 123, i.e. the PMOS transistor body or substrate, and p+ diffusion regions 125. The NMOS transistor includes a p-type well 124, i.e. the NMOS transistor body or substrate, and n+ diffused regions 126. The transistors also include gate contacts 127.

The isolation well 122 permits individual tuning of the transistor threshold voltages, by applying a bias voltage Vbp to the PMOS transistor n-type well 123, and by applying a bias voltage Vbn to the NMOS transistor p-type well 124. Each threshold voltage can be tuned by forward or reverse biasing of the PMOS or NMOS transistor bodies, i.e. wells 123, 124 using the body bias, i.e., substrate bias, voltages Vbp and Vbn. This modifies threshold voltages of the PMOS and NMOS transistors via the body effect. Control of a transistor threshold voltage via utilization of the body effect is known to those having skill in the transistor arts.

Alternative transistor embodiments include isolation means other than an isolation well. For example, transistors may be fabricated on a silicon-on-insulator (SOI) wafer. Further, a buried gate structure can be used for threshold voltage control, rather than via direct access to a semiconductor substrate.

Supply voltages, Vdd and Vss, are also applied to the transistors. In the following described embodiments, a common supply voltage, Vdd, is applied to both PMOS and NMOS transistors.

Figure 2:
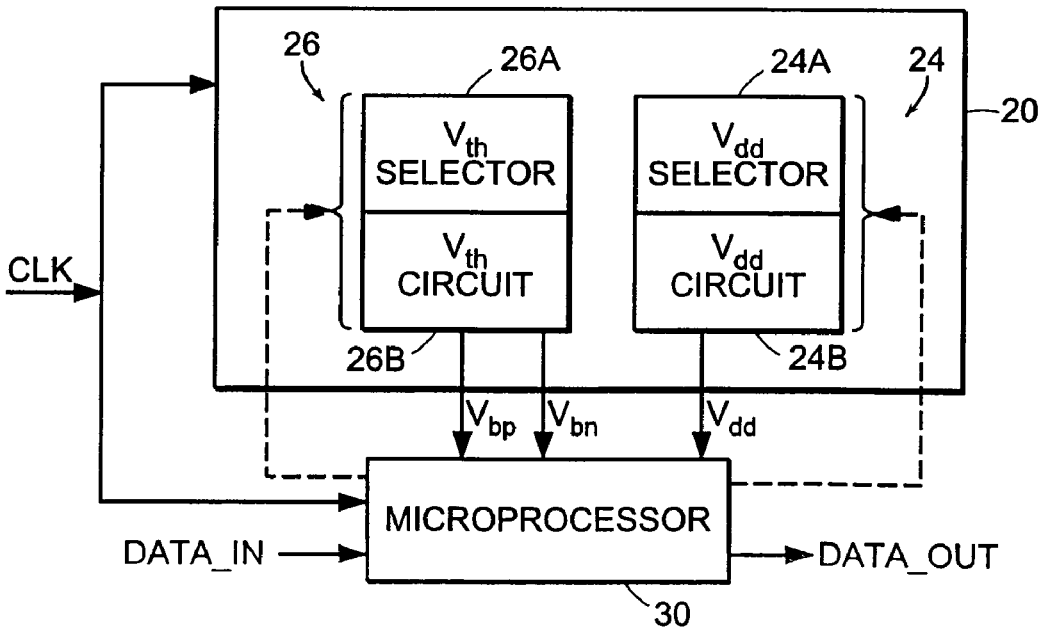
FIG. 2 is a block diagram of an embodiment of a dual loop controller.

FIG. 2 illustrates one embodiment of a controller 20 that selects and applies body bias voltages Vbp and Vbn and a supply voltage Vdd, to transistor pairs in a device. As illustrated here, the device can be a microprocessor 30.

The controller 20 includes a supply voltage control loop 24, which selects and applies a supply voltage Vdd. The controller 20 also includes a threshold voltage control loop 26, which, in cooperation with the supply voltage loop 24, selects and controls threshold voltages via application of body bias voltages Vbp and Vbn.

The supply voltage control loop 24 includes a supply voltage selector 24A for selecting a present supply voltage Vdd, and a supply voltage circuit 24B for generating and applying the selected supply voltage Vdd to the microprocessor 30.

The body bias control loop 26 includes a threshold voltage selector 26A for selecting present threshold voltages, and a threshold voltage circuit 26B for generating and applying body bias voltages Vbp, Vbn to obtain the selected threshold voltages.

A clock signal (clk) is delivered to the controller 20 and the microprocessor 30 to control a processing cycle speed. The microprocessor takes in data (data_in) and transmits data (data_out).

In preferred embodiments of an open supply voltage loop 24 or open threshold voltage loop 26, the voltage circuits 24B, 26B are supply voltage or substrate bias voltage generators. The voltage generators generate the voltages that are selected by the voltage selectors 24A, 24B.

In preferred embodiments of a closed threshold voltage loop 26 (shown in phantom), the closed threshold voltage loop 26 includes an automatic substrate bias generator. An automatic, i.e., adaptive, generator includes both a voltage generator and portions of the voltage selector 26A.

Figure 3:
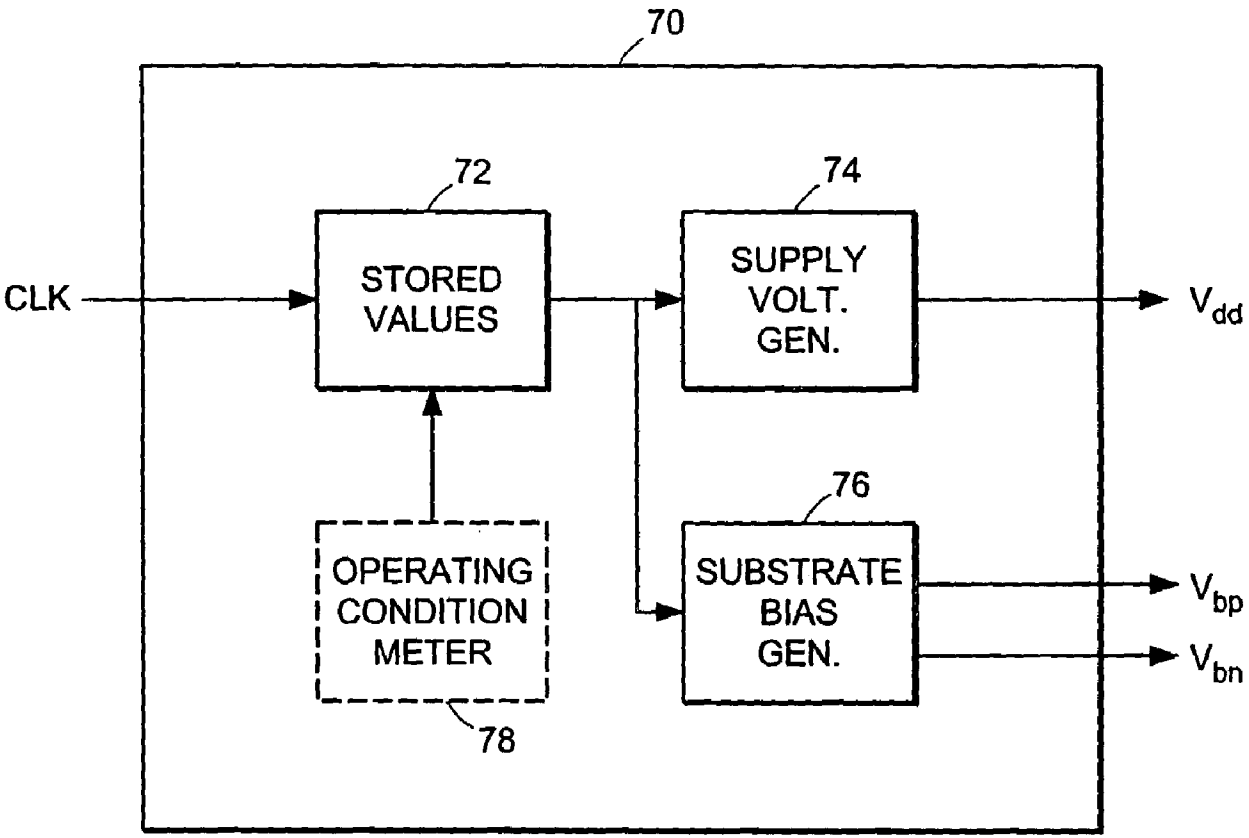
FIG. 3 is a block diagram of some embodiments of a dual open loop controller.

FIG. 3 illustrates some embodiments of a dual open loop controller 70. The controller 70 includes stored values 72, a supply voltage generator 74 and a substrate bias generator 76. The stored values 72 include preferred combinations of Vdd, Vbp and Vbn, which are correlated to values of an operating condition. The preferred values can also be correlated to a clock signal (clk), i.e., to provide a response to a present workload demand. The preferred values are determined and stored, for example, from device measurements or simulations, prior to operation of a device.

The controller 70 can include an operating condition meter 78, which measures the present value of the operating condition, during operation of the device. The presently preferred values of Vdd, Vbp and Vbn are then identified in the stored values 72 as those values that correspond to the present operating condition value, as determined prior to operation of the device. The supply voltage generator 74 then applies the presently preferred Vdd to the device, and the substrate bias generator 76 applies the presently preferred Vbp and Vbn to the device.

One embodiment of the stored values 72 includes a single lookup table. Another embodiment of stored values 72 includes a set of lookup tables. Preferably, lookup tables are software and/or hardware implemented. For example, a static random access memory ("SRAM") or a read-only memory ("ROM") can be used to store values for later reference.

In various embodiments, the controller 70 includes digital features that implement design methodologies known in the art of digital control. For example, the controller can include a digital integrated circuit, such as a digital signal processor, which implements a digital control algorithm.

More generally, the controller 70 includes a control algorithm that may be implemented in software, firmware and/or hardware (e.g. as an application-specific integrated circuit). The software may be designed to run on general-purpose equipment or specialized processors dedicated to the functionality herein described. In the case of a hardware implementation, a controller may be, for example, one or more integrated circuits. One or more integrated circuits may implement a control algorithm.

In some dual open loop embodiments that utilize a single lookup table, preferred voltage selections are output from the lookup table as a lookup table signal, which is sent to the supply voltage generator 74 and the substrate bias voltage generator 76. In response, the two generators 74, 76 apply a supply voltage (Vdd) and substrate bias voltages (Vbp, Vbn) to the device.

In one embodiment, the clock signal includes frequency data, the lookup table includes 4-bit data, and the supply voltage generator 74 and the substrate voltage generator 76 include digital-to-analog converters (D/A converters) that respond to the lookup table signal. In correspondence to present frequency data, the control loop selects a supply voltage and substrate bias voltage pair from the lookup table, stored in the form of 4-bit data. A digital signal is sent to a supply voltage generator and a substrate bias generator. The generators convert the digital signal to an analog signal, and apply the selected voltages to a device.

In other embodiments, the lookup table stores correlations between a clock signal duty ratio, or pulse width, and voltage pairs. The generators are switching regulators. Switching regulators may produce an output voltage that depends on a modulated duty ratio clock. Digital-to-analog converters and switching regulators are circuits known to those having skill in the electrical arts.

Some dual open loop embodiments utilize a set of lookup tables that are indexed to operating condition values. For example, the operating condition meter 78 can be a temperature meter, with each table of the set of lookup tables corresponding to a particular temperature value, or to a range of temperature values.

When the tables are indexed by temperature, each table provides preferred supply voltage values for a particular operating temperature. The preferred values may be determined, for example, from device measurements or simulations. Alternative embodiments include tables indexed by other environmental values, or tables with multiple indexing for multiple environmental operating condition values.

The temperature meter provides a signal, in response to a measured present temperature, that identifies a corresponding indexed lookup table for present use. The presently preferred combination of Vdd, Vbp and Vbn are selected from the lookup table identified for present use, in correspondence with a present clock frequency. A signal is sent to the supply voltage generator 74 and the substrate bias generator 76 to control application of a supply voltage (Vdd) and bias voltages (Vbp, Vbn). For example, a preferred supply voltage is chosen for a present temperature and workload demand, the workload demand indicated by the clock signal (clk).

Figure 4:
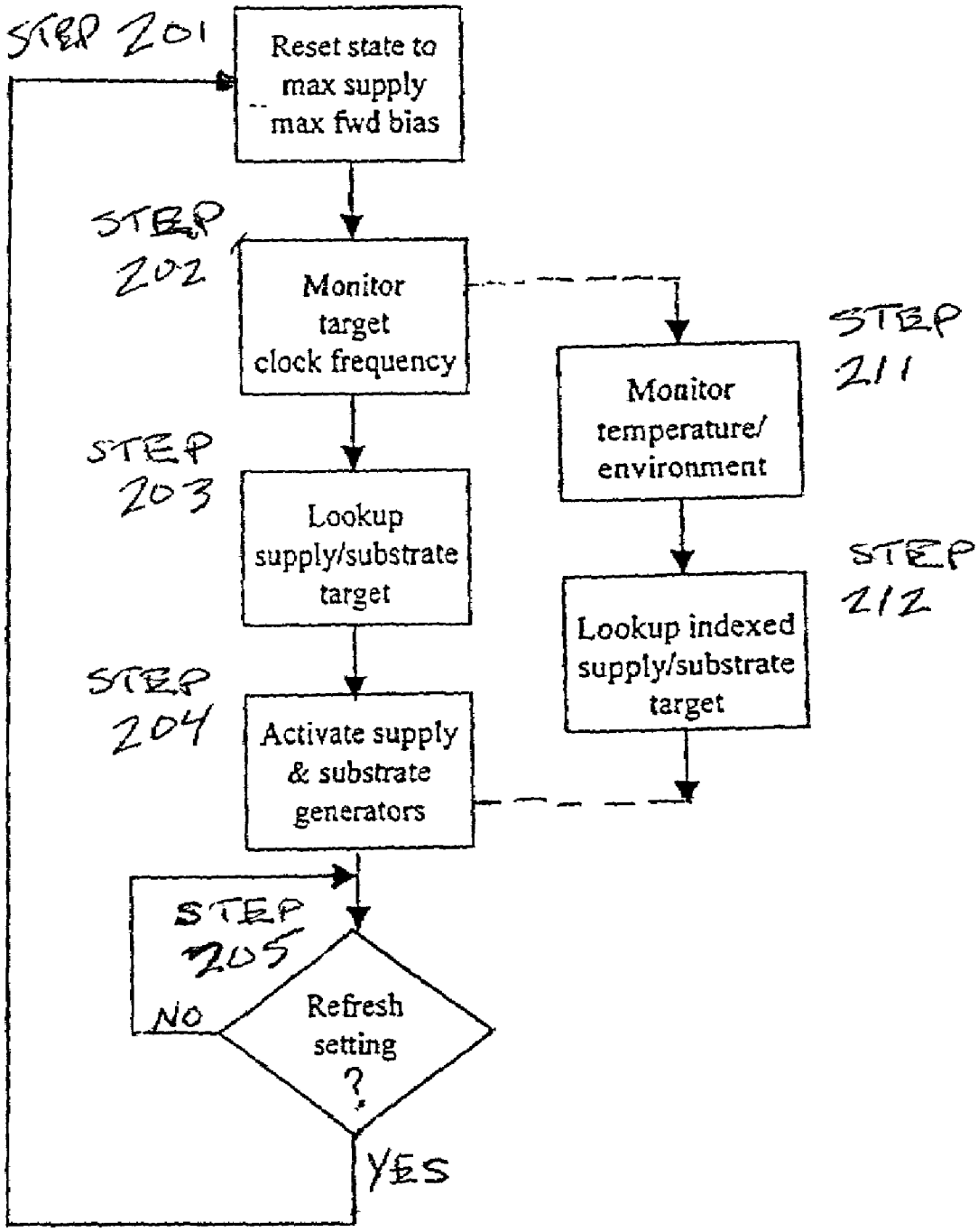
FIG. 4 is a flowchart of embodiments of a method for dual open loop control of power consumed by an electronic device.

FIG. 4 is a flowchart that illustrates some embodiments of dual open loop control methods, which, for example, can be implemented by the dual open loop controller 70 of FIG. 3.

A supply voltage is set to a maximum setting obtainable by a supply voltage generator, and a bias voltage is set to a maximum forward bias voltage obtainable by a bias voltage generator (Step 201). A target frequency is monitored (STEP 202), for example, by monitoring a clock signal. Knowledge of the target frequency can permit a response to the present workload demand of a device; preferred supply and substrate bias voltages can be selected in response to the present workload demand.

A lookup table identifies a supply voltage and substrate bias voltage pair that corresponds to the target frequency (Step 203). The supply voltage generator and bias voltage generator are activated at the voltage pair identified from the lookup table (Step 204). The process may be refreshed (Step 205), i.e. repeated, if a new operating frequency is selected or if an environment condition changes. A reset state is set to a maximum performance (i.e., fastest clock rate) before a new target frequency is selected.

In some dual open loop embodiments, an environmental parameter, for example, temperature is monitored (Step 211), in addition to the monitoring of the target frequency (Step 202). Lookup tables, which are indexed according to environmental parameter values, can then identify supply voltage and substrate bias voltage pairs that correspond to the target frequency and the present environmental parameter value (Step 212).

Figure 5:
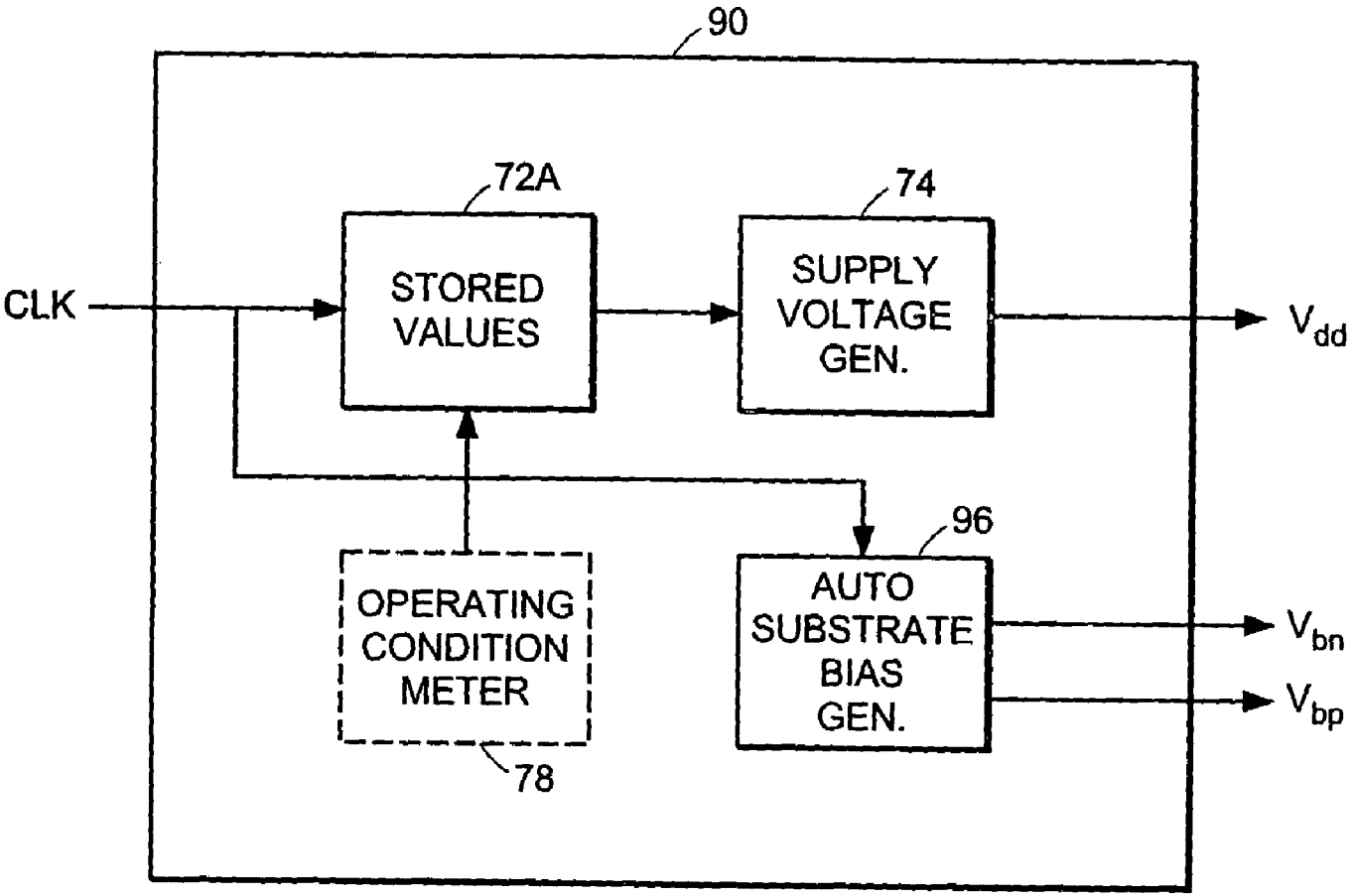
FIG. 5 is a block diagram of embodiments of a hybrid dual loop controller.

FIG. 5 illustrates some embodiments of a hybrid dual loop controller 90. The hybrid loop controller 90 includes an automatic substrate bias generator 96 in place of the substrate bias generator 76 of the dual open loop controller 70. Other components of the hybrid loop controller 123 are similar to those of the dual open loop controller 70.

The hybrid loop controller 90 utilizes an open loop for selection and control of a supply voltage and a closed loop for selection and control of a threshold voltage. The open loop includes the stored values 78 and the supply voltage generator 74. Only the open loop makes use of the stored values 78, for example, a lookup table or lookup tables. The closed loop includes an automatic substrate bias generator 126, which, in response to a present operating condition, automatically selects and applies a substrate bias voltage during operation of a device.

The input clock signal (clk) passes to the automatic substrate bias generator 96, which selects preferred values for a PMOS transistor body bias voltage (Vbp) and a NMOS transistor body bias voltage (Vbn) for application to the circuit. The preferred values for Vbp and Vbn are selected, for example, by surveying a range of Vbp and Vbn values for the given clock signal and the supply voltage.

The closed loop includes the automatic substrate bias generator 96, which, in response to a present operating condition, automatically selects and applies a substrate bias voltage during operation of a device. The automatic substrate bias generator 96 responds to the present operating condition in the sense that the bias voltage selection process is performed in an environment that is subject to the present operating condition.

The automatic substrate bias generator 96, for example, an automatic body bias generator, in one embodiment is a delay locked loop circuit (DLL) that attempts to exactly match the clock period by matching the delay through a critical path. Thus, for a given clock frequency, the body bias voltage values are automatically chosen so that the circuit speed matches the clock speed. The circuit then operates as fast as required, without wasting excess power by operating at a higher speed than necessary for the present task.

Figure 6:
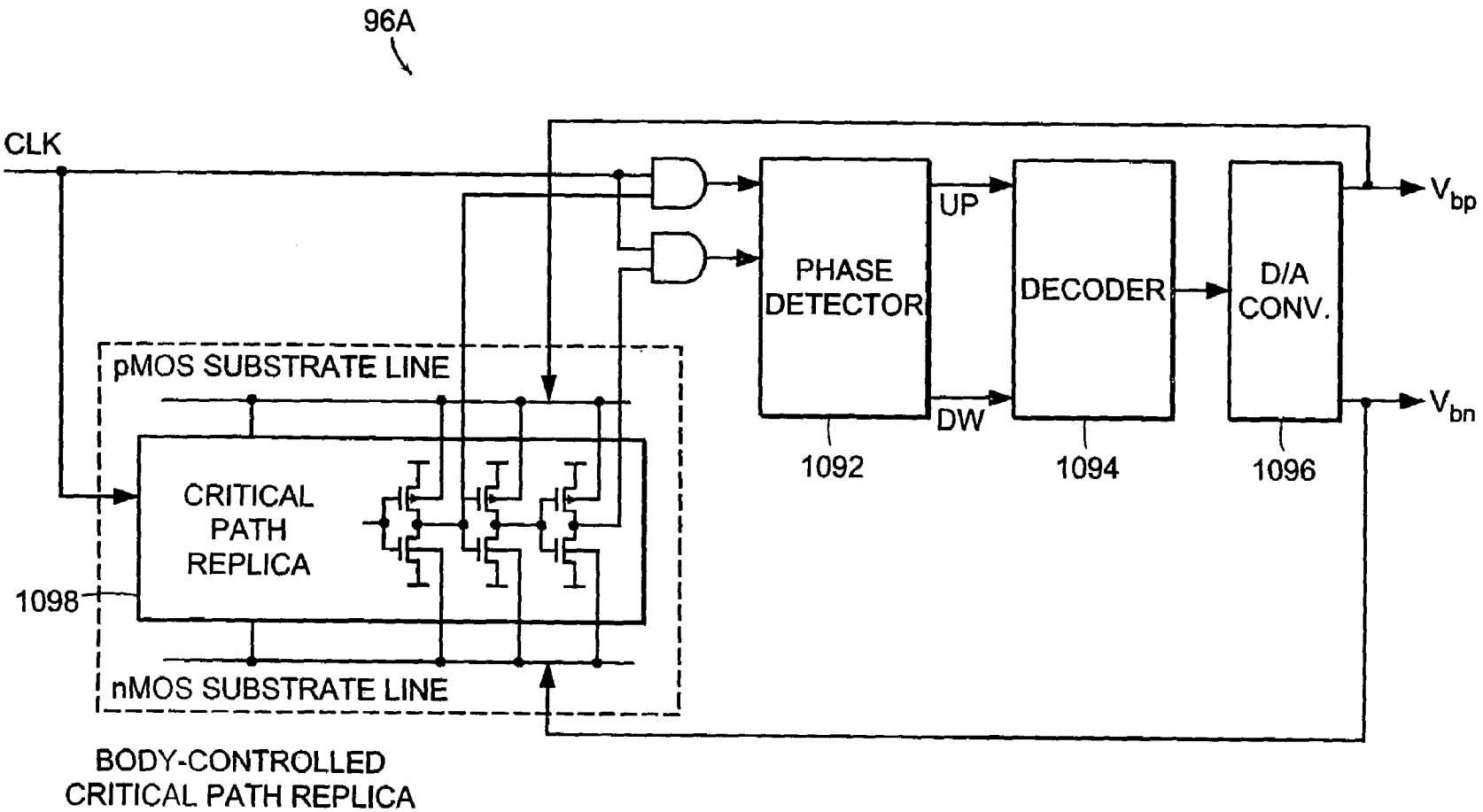
FIG. 6 is a block diagram of an embodiment of a delay locked loop that may be utilized as an automatic substrate bias generator.

FIG. 6 illustrates one embodiment of a DLL 96A, which may be utilized as the automatic substrate bias controller 96. The DLL 96A includes a phase detector 1092, a decoder 1094, a digital-to-analog (D/A) converter 1096 and a body-controlled critical path replica 1098. The DLL 96A provides adaptive body bias voltages in response to the present clock (clk) value, and in response to a present operating condition of the device, where the device is modeled by the critical path replica 198.

As known to those having skill in the electrical engineering arts, a critical path is generally understood to refer to the path through a circuit that determines the ultimate speed of the circuit. Hence, a circuit that replicates the behavior of the critical path may provide a satisfactory model of behavior of the actual circuit. This is of utility when, for example, measurements on the actual circuit are impractical.

A critical path replica may be produced, for example, for a processor, by fully characterizing the processor. The replica may be implemented, for example, as a set of inverters, or non-inverting inverters. A replica circuit may be programmable, for example, by determining which inverters are inserted into the critical path replica.

Figure 7:
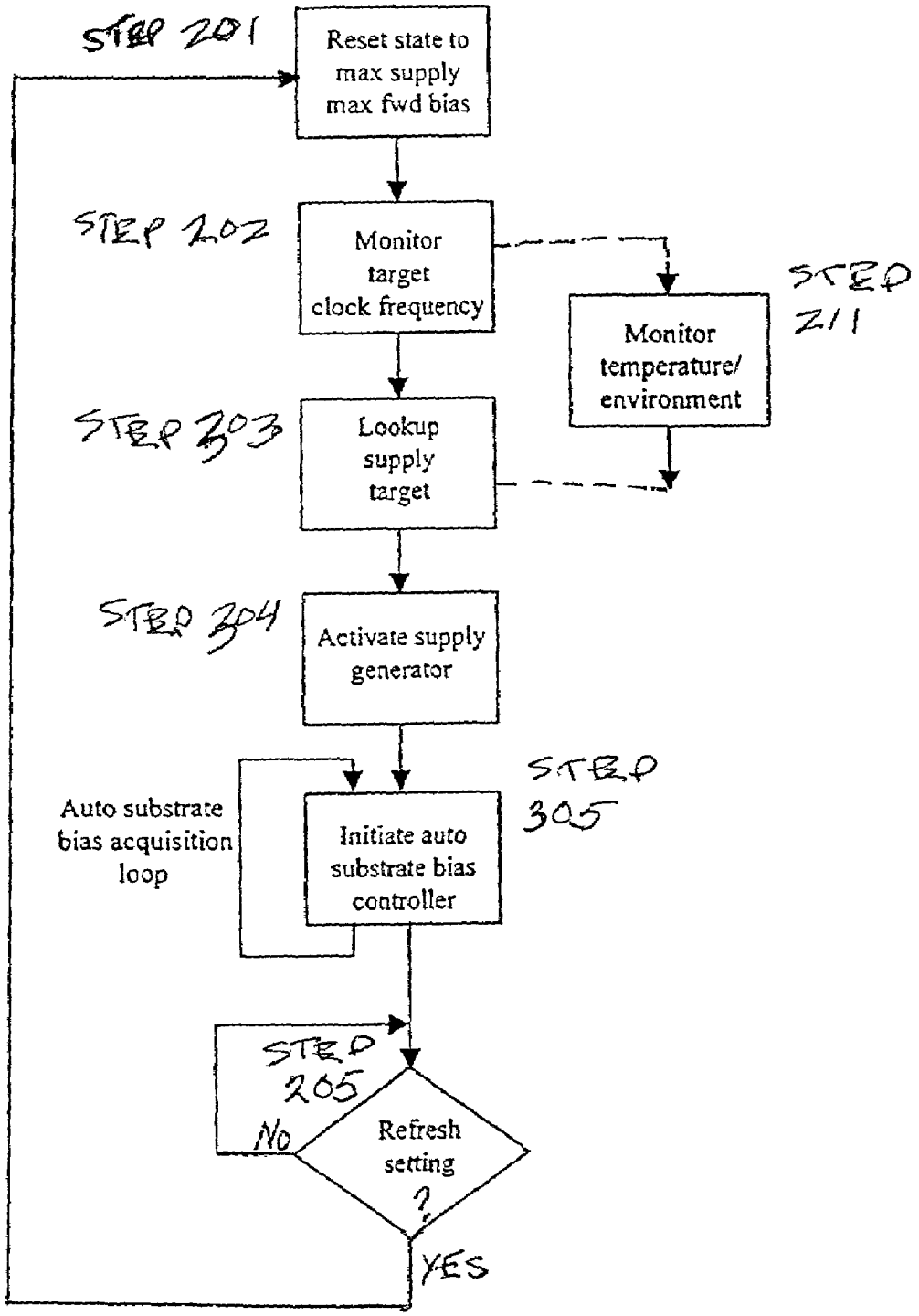
FIG. 7 is a flowchart of embodiments of a method for hybrid dual loop control of power consumed by an electronic device.

FIG. 7 is a flowchart that illustrates some embodiments of hybrid loop control methods, as can be implemented, for example, by the hybrid loop controller 90 of FIG. 5. The following description focuses on those steps that are distinct from the dual open loop embodiments illustrated by FIG. 4.

A lookup table stores and identifies a supply voltage value that corresponds to the present target frequency (Step 303). If an environmental parameter is monitored (Step 211), the lookup table can store and identify a supply voltage value that corresponds to both the present target frequency and the presently determined value of the environmental parameter. The supply voltage generator is activated at the voltage identified from the lookup table (Step 304).

Further, a substrate bias voltage selection process is initiated by an automatic substrate bias controller (Step 305). For example, an automatic substrate bias generator is stepped through a series of substrate bias voltages to select the presently preferred substrate bias voltage in response to the present operating conditions of the device.

For a fixed supply voltage setting, as identified from the lookup table, an internal control loop of the automatic substrate bias controller automatically selects an appropriate body biasing setting. The automatic substrate bias controller may maintain an iso-performance curve for a fixed supply voltage setting. The controller may periodically refresh its voltage selection, in response to changing operating parameters.

Figure 8:
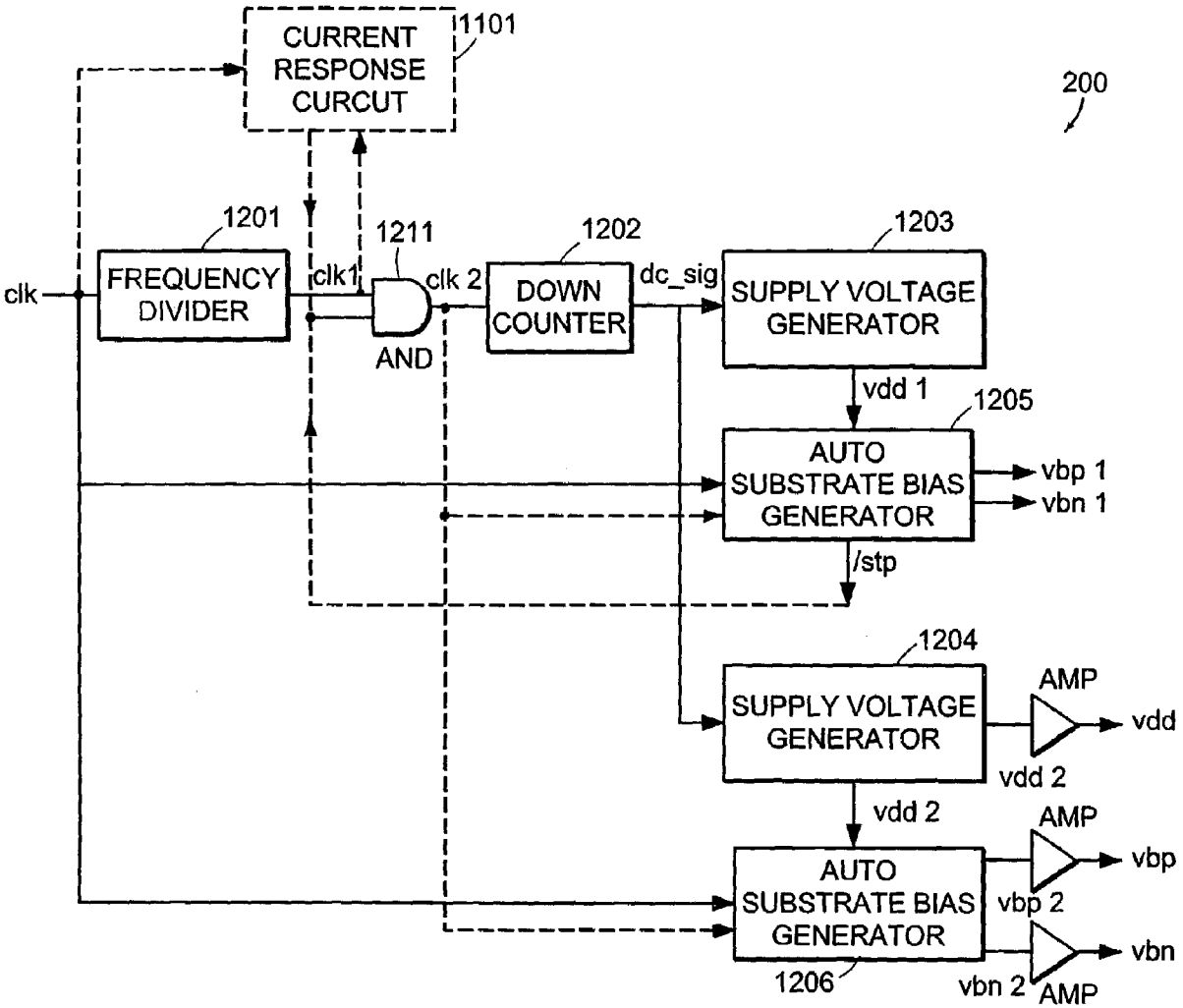
FIG. 8 is a block diagram of some embodiments of a closed, dual loop controller.

FIG. 8 illustrates some embodiments of a closed, dual loop controller 200. The dual loop controller 34 generates a supply voltage (vdd), a substrate bias voltage for PMOS transistors (vbp) and a substrate bias voltage for NMOS transistors (vbn). The voltages may be applied, for example, to a microprocessor.

The controller 200 includes a frequency divider 1201, an AND gate 1211, a down counter 1202, two supply voltage generators 1203, 1204 and two automatic substrate bias generators 1205, 1206. Both supply voltages and bias voltages are varied during operation of a device to determine preferred supply and bias operating voltages for the device.

During determination and selection of presently preferred voltages, the down counter 1202 controls stepping of the supply voltage generators 1203, 1204 while the automatic substrate bias generators 1205, 1206 survey a range of bias voltages for a given supply voltage setting.

The frequency divider 1201 divides the clock signal (clk) and provides a dual loop control update rate that is much slower than the system clock (clk). The down counter 1202 counts down in response to the divided clock signal. The first supply voltage generator 1203 generates a first supply voltage (Vdd1) in response to a DC voltage signal (dc_sig) received from the down counter 1202. The second supply voltage generator 1204 generates a second supply voltage (Vdd2) in response to a DC voltage signal (dc_sig) received from the down counter 1202.

When the preferred settings change such that an applied Vdd1 is less than the preferred value, the automatic substrate bias generator 1205 may be unable to attain the preferred substrate bias voltage. In this case, the automatic substrate bias generator 1205 preferably applies the maximum forward substrate bias voltage that it can deliver. The automatic substrate bias generator 1205 may send a stop signal (/stp) to the down counter 1202, via the AND gate 1211, to stop the down count. The AND gate 1211 serves to stall the clk1 signal so the down counter 1202 value stops changing.

Periodic resetting of the supply voltage generators 1203, 1204, for example once per minute, may be used to reduce or nearly eliminate temperature-based performance fluctuations. Moreover, an automatic substrate bias generator may compensate for fabrication process variations.

Some embodiments can achieve saturated forward biasing without stalling of a device. For example, the signal from the AND gate 1211 (clk2) may act as a reset signal for the automatic substrate bias generators 1205, 1206.

The supply voltage generator 1204 and the automatic substrate bias generator 1206 drive a device, and lag by one clock tick the data used by the supply voltage generator 1203 and the automatic substrate bias generator 1205, which bias, for example, a critical path replica and the current response circuit 1101. If the loop should be stopped, i.e., if the loop has just passed the optimum operating point, the device would be biased to the previous value, i.e., the optimum value. Another embodiment uses a control mechanism that backtracks one step to a previous valid value once a target is exceeded. Such an embodiment, however, can interrupt the operation of a device.

Figure 9:
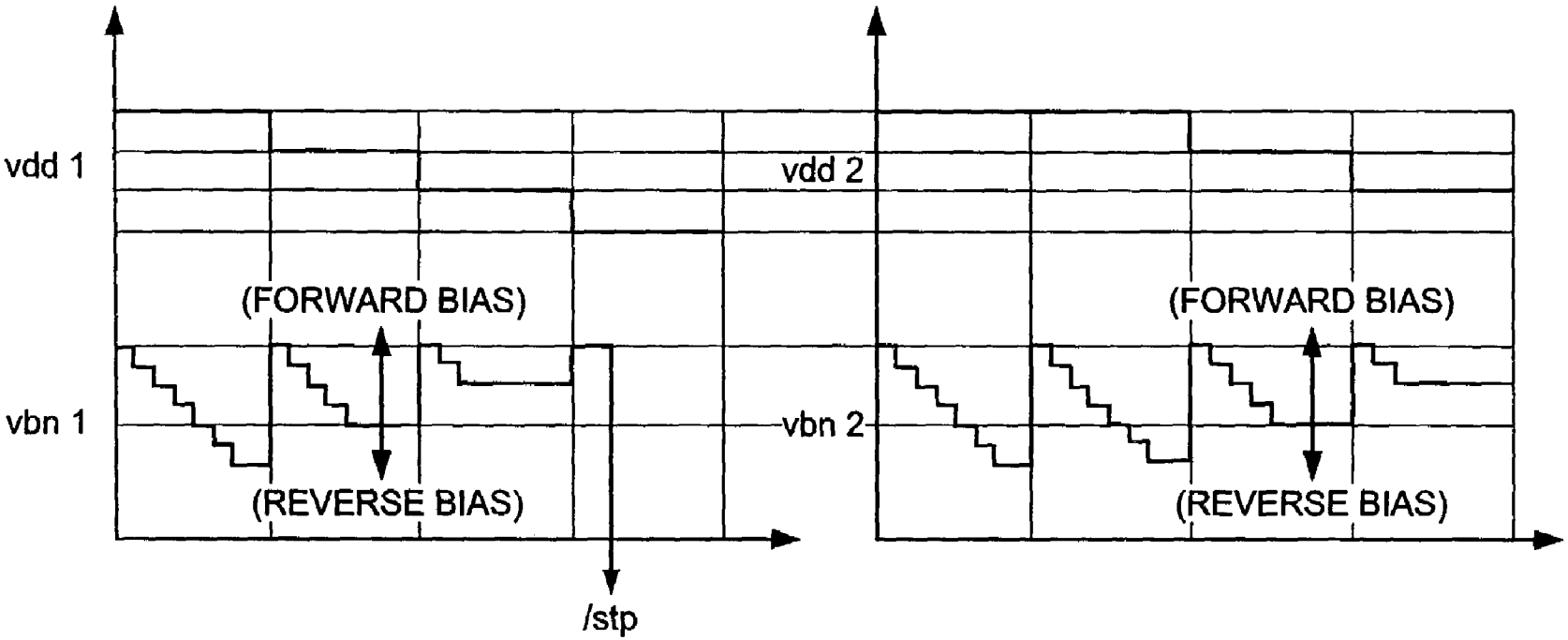
FIG. 9 is a graph that compares supply voltage and substrate bias voltage changes over time for one embodiment of a closed dual loop controller.

FIG. 9 is a graph that illustrates how the signal from the AND gate 1211 (clk2) may act as a reset signal for the automatic substrate bias generators 1205, 1206. When the supply voltages are changed, the automatic substrate bias generators 1205, 1206 are reset to generate a maximum available forward bias, as illustrated by the graph of FIG. 8. This embodiment provides continuous operation of a device during changes to the operating voltages. After each step change of the supply voltage generators 1203, 1204, the automatic substrate bias generators 1205, 1206 are reset so that they generate a maximum forward bias, as illustrated by the graph.

Some embodiments include a current response circuit 1101 rather than including use of a stop signal (\stp). In one embodiment, the current response circuit includes an excess current detector.

Figure 10:
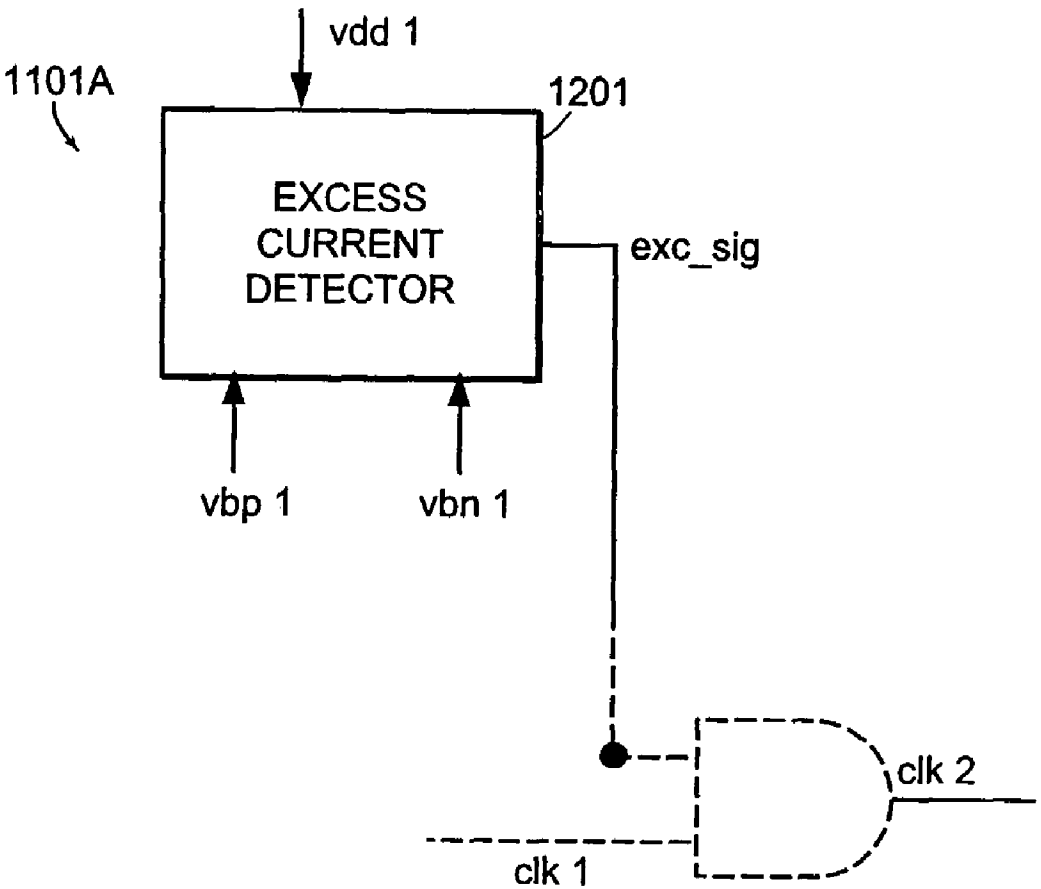
FIG. 10 is a block diagram of an embodiment of an excess current detector, which can by used as the current response circuit of FIG. 8.

FIG. 10 illustrates one embodiment of an excess current detector 1101A. The excess current detector 1101A monitors Vdd1, Vbp1 and Vbn1. When the substrate current increases suddenly at an optimum bias point because of the p-n junction current, the excess current detector 1101A determines the occurrence of the sudden current increase.

Figure 11:
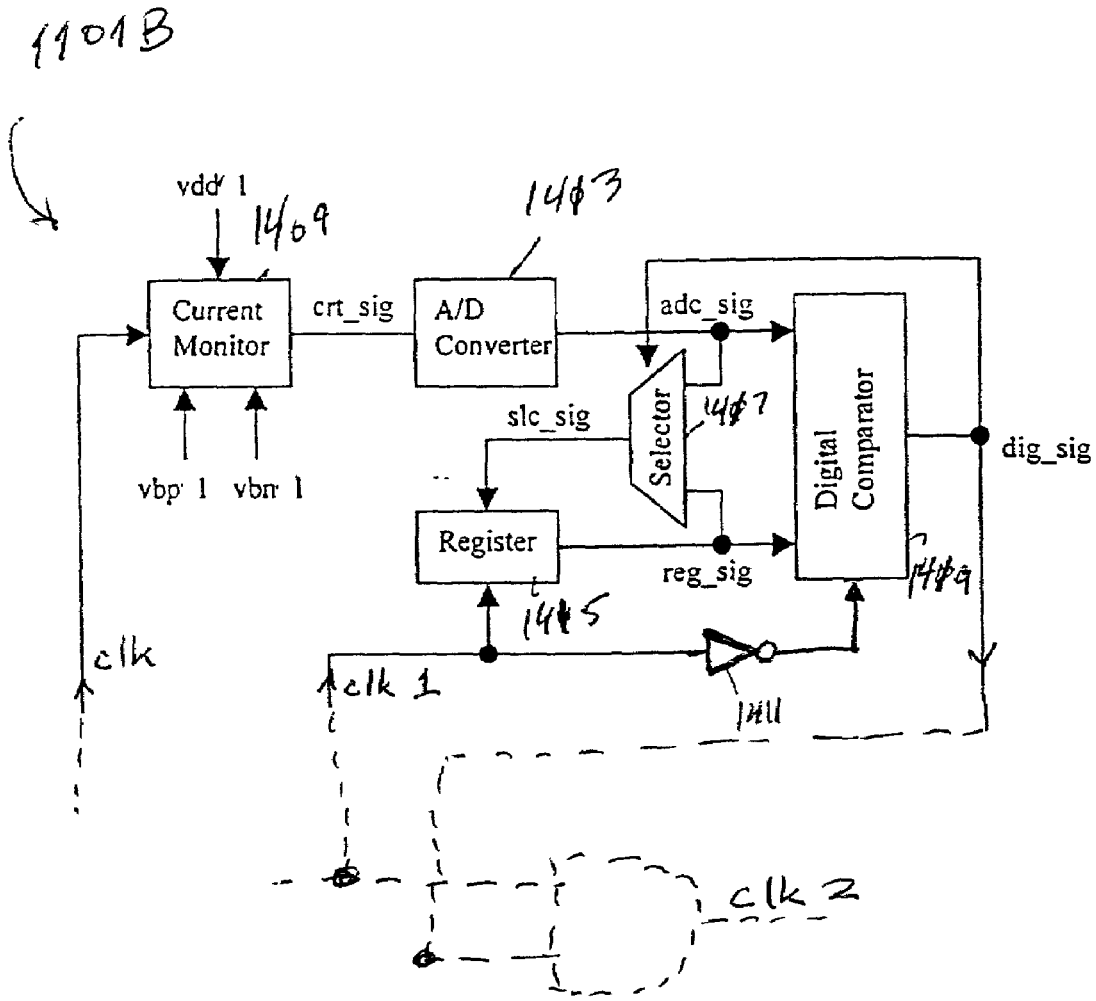
FIG. 11 is a block diagram of an embodiment of a current response circuit that includes a current monitor.

When an excess current is detected, an excess current signal (exc_sig) is sent to the AND gate 1211. The excess current detector 1101A may thus cause the down counter 1202 to stop changing the supply voltage. Hence, the excess current detector 1101A may replace the role of the stop signal. A microprocessor, for example, may be halted during a Vdd, Vbp and Vbn settling period. After voltages are locked, the microprocessor may resume operation. Again, a device may be operated without any halting by using the output of the AND gate 1211 as a reset signal FIG. 11 illustrates another embodiment of a current response circuit 1101B. The circuit 1101B includes a current monitor 1409, an A/D converter 1413, a digital comparator 1419, a register 1415, an inverter circuit 1411 and a selector 1417. The current response circuit 1101B enables an optimum point of operation that is not limited by well forward bias currents.

The current monitor 1409 monitors Vdd1, Vbp1 and Vbn1 and produces a corresponding voltage signal (crt_sig). The A/D converter 1413 changes the voltage signal to, for example, a 4-bit digital signal (adc_sig). The digital comparator 1419 compares the signal from the A/D converter 1413 with the signal (reg_sig) from the register 1415. The register 1415 receives the output signal (clk1) from the frequency divider 1201, as does the comparator 1419, and a signal (slc_sig) from the selector 1417. The selector 1417 produces an output signal (slc_sig) in response to the A/D converter 1413 output signal (adc_sig) and the register 1415 output signal (reg_sig).

The inverter circuit 1411 receives the clock signal (clk1), and outputs a "high" signal (i.e., "true") when clk1 is "low" and outputs a "low" signal (i.e., "false") when clk1 is "high". The digital comparator 1419 receives the inverted clk1 signal from the inverter circuit 1411, e.g., a "false" clk1 signal; the digital comparator 1419 synchronizes an output dig_sig signal with a "false" clk1 signal. This provides different operation timing for the digital comparator 1419 and the register 1415, the latter receiving the "true" clk1 signal.

When the adc_sig value is smaller than the reg_sig value, the comparator 1419 supplies a "high" signal to the AND gate 1211. The down counter 1202 may then continue to count down the reduction of supply voltages, and the adc_sig value is stored in the register 1415. When the adc sig value is greater than the reg_sig value, the comparator 1419 supplies a "low" signal to the AND gate 1202. The down counter 1202 then stops, and the register 1415 may store the present data.

The current monitor 1409 measures current or power. The A/D converter 1413 converts the current measurement or the power measurement into a binary signal. Usually, a power measurement is more accurate, and a current measurement is easier to implement. A/D converters may be implemented with a variety of circuit techniques known to those with skill in the electrical arts.

The presently described embodiment is particularly useful for application to very low threshold voltage devices. Low threshold voltage devices may consume a relatively large amount of leakage current losses. In such devices, an optimum point of substrate bias may be larger than the maximum performance point.

In one embodiment, the current response circuit 1101B FIG. 11 is operated as now described. The circuit 1101B collects a series of current readings; the register 1415 holds the collected reading previous to the most recent reading. The dual loop controller 200 steps down the iso-performance curves to find the minimum operating point; as the controller 200 counts down, the latest power readings are typically lower than the previous ones. If, however, the next step causes the power reading to be higher than the previous one, the optimal condition was reached at the previous step.

Figure 14A:
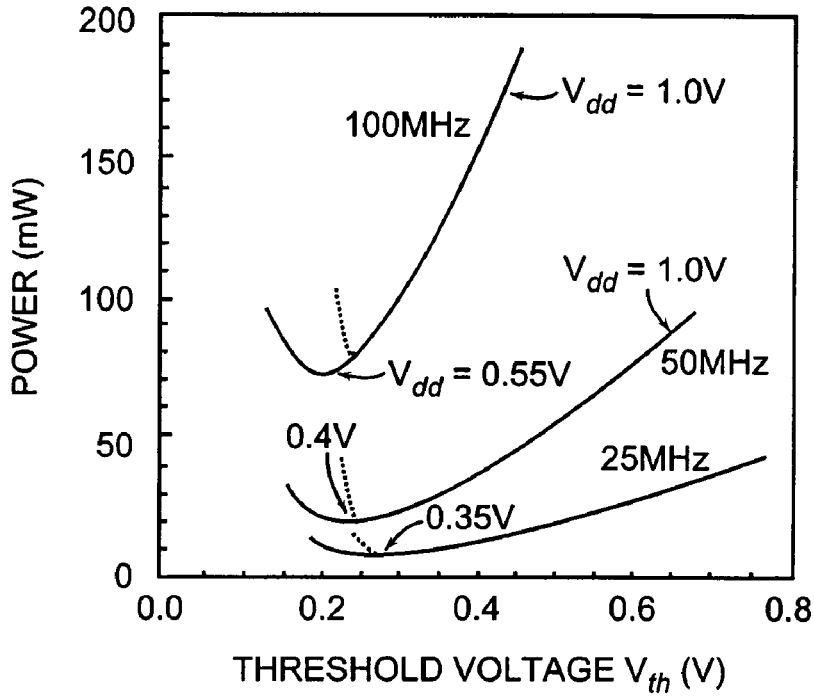
FIGS. 14A and 14B are graphs of power consumption as a function of threshold voltage, supply voltage and applied clock frequency for a simulated embodiment of a CMOS reduced instruction set (RISC) microprocessor.

This method is applicable, for example, when the optimum point is passed in a gradual iso-performance curve (see, for example, the solid curves in FIG. 14A). This method of operation is also applicable, for example, to devices that are forward bias limited. In such a case, a sudden current spike occurs when the limit of forward biasing is reached. Use of a current monitor 1409 is generally suitable when a device cannot physically reach the theoretical optimum limit. In such a case, the optimal condition can be obtained by pushing the forward bias as much as possible until, for example, transistors are overcome with an unacceptably high current spike (i.e., for forward biased p-n junctions).

In an embodiment that is not forward-bias limited (e.g., no current spikes), the controller 200 preferably utilizes power measurements rather than current measurements. Thus, the current response circuit 1101B is preferably utilized to detect current spikes (in a forward bias limited scenario), but would preferably be modified to compare power in a more general case. For example, one embodiment of a current response circuit replaces the current monitor 1409 of the current response circuit 1101B with a power monitor to accommodate the above-described more general case.

Figure 12:
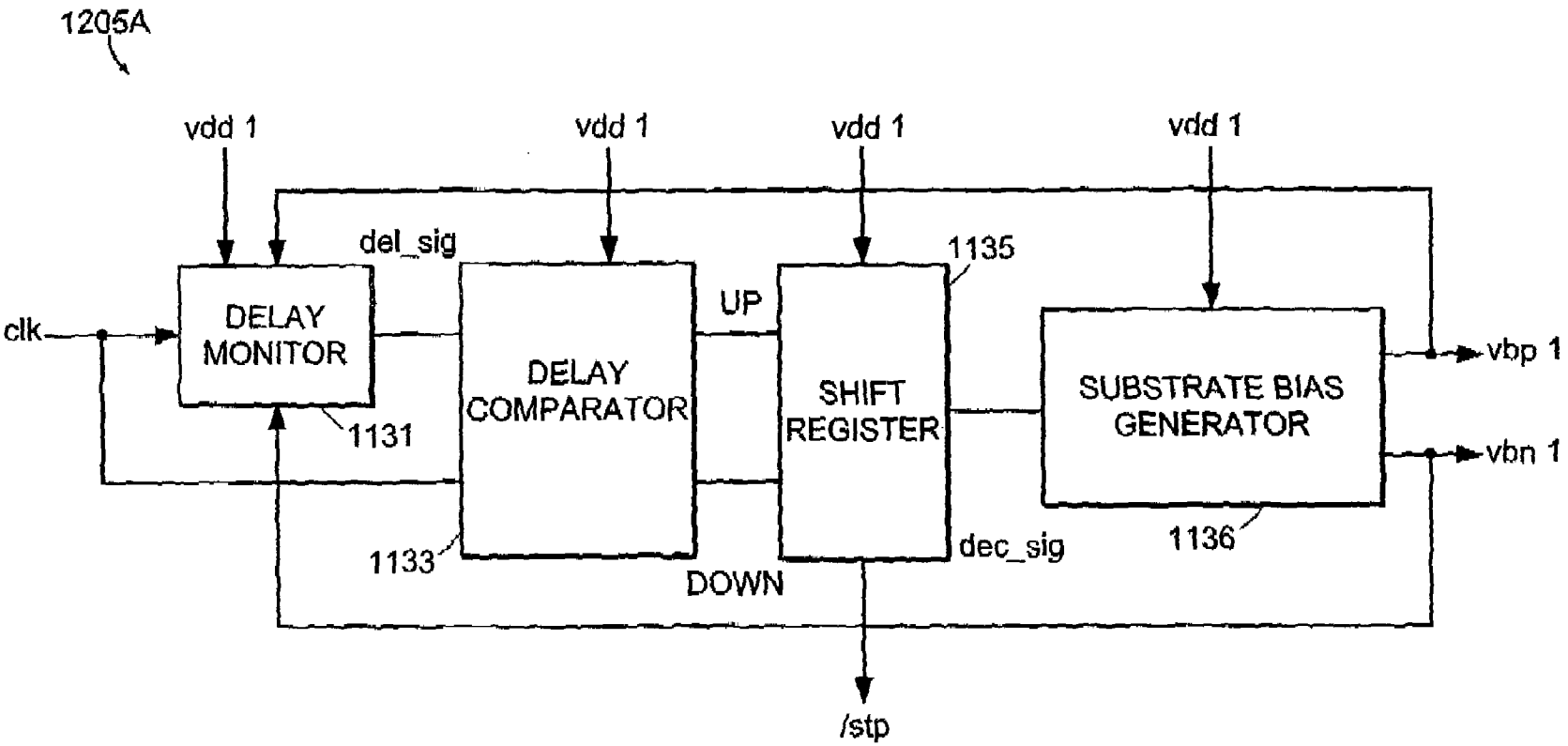
FIG. 12 is a block diagram of one embodiment of an automatic substrate bias generator.

FIG. 12 is a block diagram of one embodiment of a automatic substrate bias generator 1206A, which can serve as the generator 1206 shown in FIG. 8. The generator 1206A includes a substrate bias generator 1136, a shift register 1135, a delay comparator 1133 and a delay monitor 1131. The generator 1206A uses a DLL to lock a critical path to match a desired clock period.

The delay monitor 1131 can be implemented, for example, with a chain of inverters. In another embodiment, a delay monitor includes a critical path replica of a device. The latter embodiment may provide closer matching between a matched delay line and the device circuit.

Figure 13:
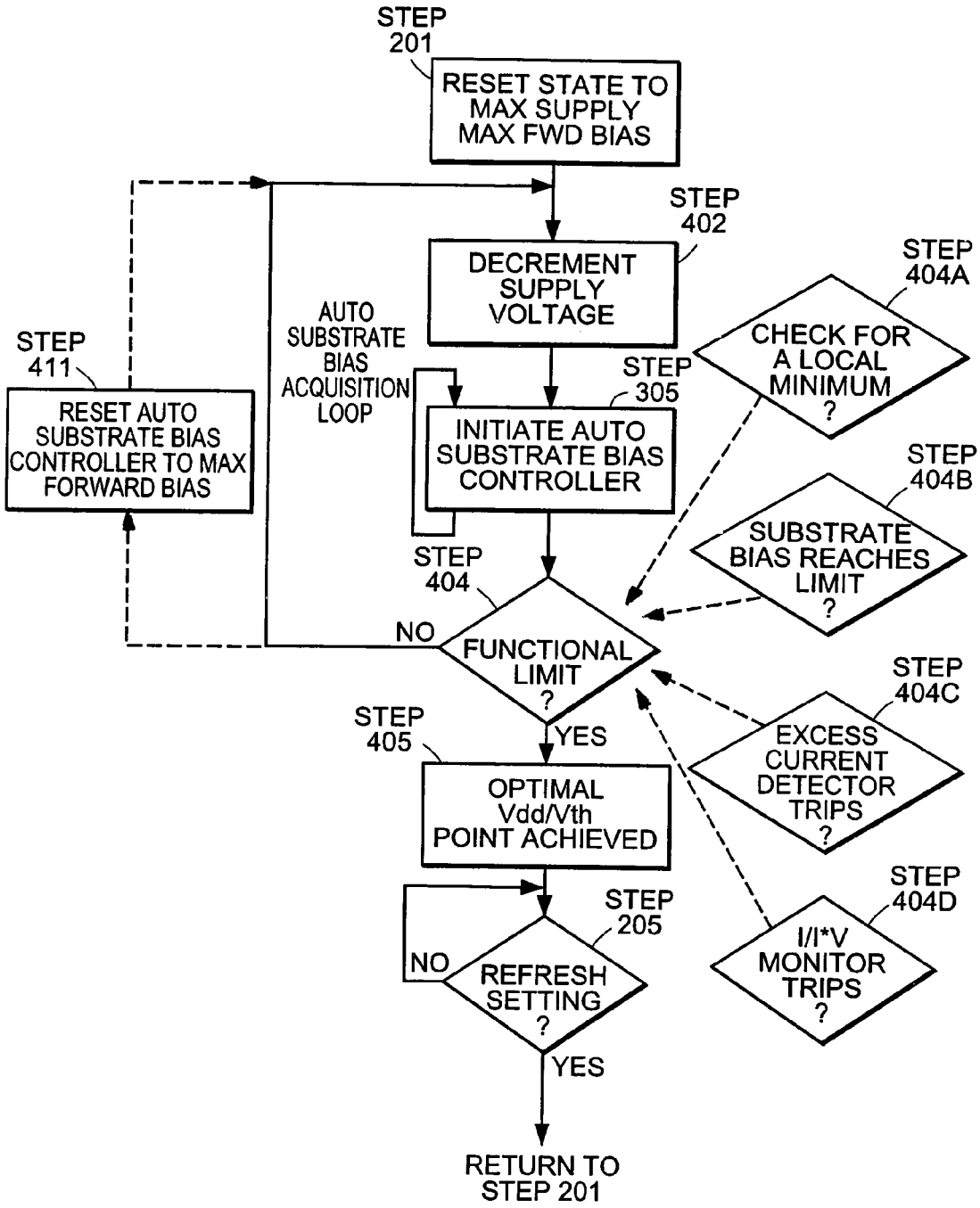
FIG. 13 is a flowchart of some embodiments of dual closed loop control methods of power consumed by an electronic device.

FIG. 13 illustrates some embodiments of dual closed loop control methods, as can be implemented, for example, by the closed, dual loop controller 200 of FIG. 8. The following description focuses on those steps that are distinct from the dual open loop and hybrid loop embodiments illustrated by FIGS. 4 and 7.

The method divides the dual control loop into two independent, though cooperating, closed loops: 1) a loop that automatically selects a substrate bias; and 2) a loop that decrements a supply voltage. The substrate biasing loop automatically chooses a preferred body bias voltage value to meet a performance requirement for a given supply voltage. In other words, the substrate biasing loop, after setting of a given supply voltage, automatically selects a preferred body bias value to ensure that the device operates on an iso-performance curve.

A controller then steps the supply voltage to smaller voltage values, allowing the substrate bias generator, at each step, to select the preferred bias voltage value. Monitoring the power dissipation of the circuit, for example, by using a test monitor or via direct measurements of power, may then permit selection of a supply voltage and threshold voltage pair that provide a preferred power, for example, a minimized power. The controller may be a part of the device, or may be an outside controller.

In a closed loop system, it is generally preferable to step downward in supply voltage and to repeatedly sweep a bias voltage to vary a threshold voltage at each downward step to find a preferred voltage pair. The converse implementation, i.e., stepping a bias voltage to step a threshold voltage and sweeping supply voltage, may be more difficult. Further, the voltage ranges typically of interest lend themselves to the former implementation.

In more detail, with reference to FIG. 13, a supply voltage is stepped downward in voltage value (Step 402), and, at each step in supply voltage, the body bias voltage is varied to seek a power minimum (Step 305). For example, the automatic substrate bias controller steps through a series of substrate bias voltages to select the presently preferred substrate bias voltage in response to the present operating conditions of the device.

Steps 402 and 305 are repeated until a preferred supply voltage and threshold voltage pair are determined (Step 405). The preferred pair provides an optimal Vdd/Vth point, i.e., a minimal power consumption. The determination process may be repeated, for example, when the device temperature changes, or the workload demand changes. Such events indicate a change in the preferred operating voltage pair.

For each decrement of the supply voltage, the substrate bias voltage selection process (Step 305) can be initiated by an automatic substrate bias controller. For example, an automatic substrate bias generator can step through a series of substrate bias voltages to select the presently preferred substrate bias voltages (Vbp, Vbn) in response to the present operating condition of the device.

Another embodiment of a dual closed loop control method has particular utility when applied to devices that have a preferred supply voltage and threshold voltage that are limited by forward bias saturation.

Still referring to FIG. 13, Steps 402 and 305 may be repeated until a functional limit is reached (Step 404). A functional limit test can be implemented via various alternative embodiments, as indicated by the four broken arrows. For example, the functional limit test (Step 404) can comprise: a power consumption minimum test (Step 404A); a substrate bias limit test (Step 404B); an excess current limit test (Step 404C); and a current/power ("I/I*V") limit test (Step 404D).

In one embodiment of the substrate bias limit test (Step 404B), the device may be stalled while selecting the preferred operating voltages. If the substrate bias limit is not reached, the automatic substrate bias controller is reset to a maximum available forward bias (Step 411) before repeating steps 402, 305 and 404B.

In one embodiment of the excess current condition test (Step 404C), an optimal voltage pair would usually be a pair determined at the onset of an excess current condition. This method permits operation of a device without halting.

In some embodiments, a current monitor and related circuitry signals the excess current condition (Step 404C). The preferred supply voltage and threshold voltage pair are determined after the excess current condition is determined (Step 405). Again, the process may be refreshed (Step 205), for example, if a new operating frequency is selected, or environmental conditions change. A device may be halted while adjusted voltages settle. After voltages are locked, the device may resume operation.

In this embodiment, an optimal supply voltage and threshold voltage pair may be determined before onset of forward bias saturation. Thus, there can be a gradual optimum point. That is, the power curve is gradually varying in the vicinity of its minimum.

At each sample point, a supply voltage may be stepped down, and an automatic substrate bias generator may automatically select a preferred body bias value to meet the performance requirements at each fixed supply voltage.

The supply voltage is continually stepped down until the current detection circuitry trips, while measuring, for example, current or power, indicating that an optimal operating point has been attained.

In one embodiment of an I/I*V test, steps 402 and 305 are repeated until a current monitor trips (Step 404D). A preferred supply voltage and threshold voltage pair are determined after the current monitor trips.

The current monitor may measure current or power, i.e., power can be determined from current and voltage. Usually, a power measurement is more accurate, and a current measurement is easier to implement.

Figure 14B:
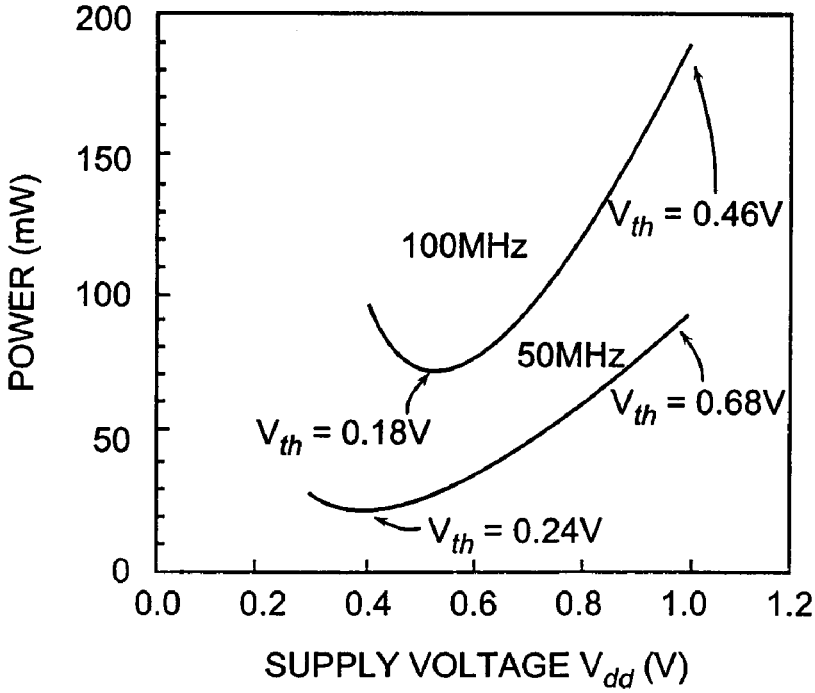

FIGS. 14A and 14B are graphs that illustrate power consumption as a function of threshold voltage, supply voltage and applied clock frequency for a simulated embodiment of a CMOS reduced instruction set ("RISC") microprocessor. For example, when a workload requirement demands a 100 MHz operating frequency, a 0.5V supply voltage and a 0.18V threshold voltage provide a minimum power consumption. This is illustrated by the location of the minima in the 100 MHz curves in the two graphs. The threshold voltage may be defined as a gate voltage that causes a drain current to become 1 nA per 1 $\mu$m of gate width.

The power minimum for a 50 MHz operating frequency, i.e., a lower workload, is at a 0.4V supply voltage and a 0.24V threshold voltage. With further Vth and Vdd scaling, the rate at which subtheshold leakage current increases becomes greater than the rate at which dynamic currents are reduced, thus power consumption increases above the minimum.

Figure 15:
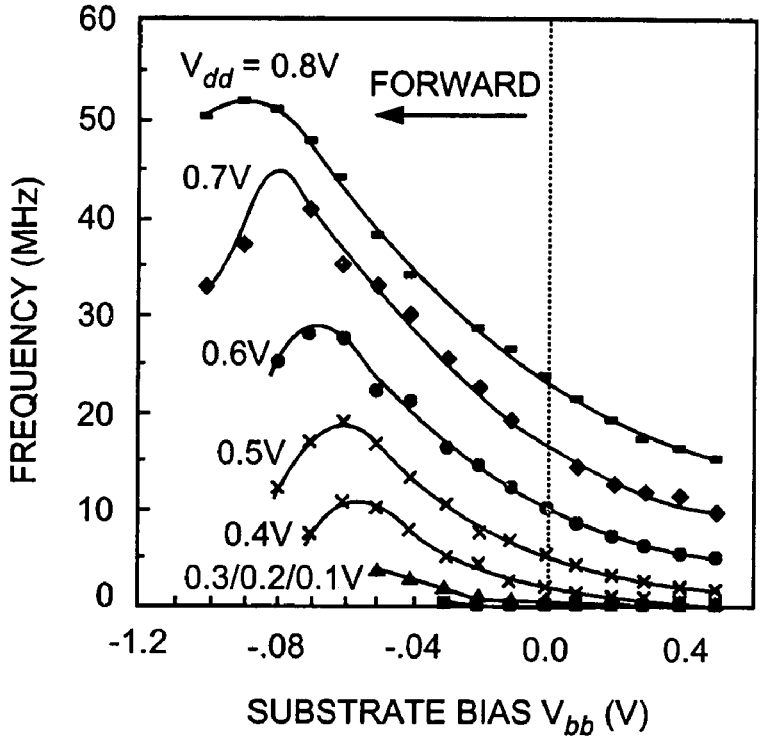
FIG. 15 is a graph of the dependence of frequency on substrate bias voltage for a ring oscillator in a sample embodiment of a digital signal processor.

Referring to FIG. 15, one embodiment of a system for controlling power consumption of a device was fabricated for demonstration of control via adaptive substrate biasing. The sample circuitry included a DSP core. The DSP core included a ring oscillator and sixteen 16-bit multiply-accumulate ("MAC") units. The ring oscillator design incorporated the critical path of a MAC unit.

Fabrication of the circuitry utilized a 0.14 $\mu$m CMOS process with a 3.2 nm gate insulator, 5-layer interconnect and triple-well transistor pair structure. The threshold voltage (Vth) of MOS components in the circuitry was 0.05V, where Vth was defined as a gate voltage at a drain current of 1 nA/$\mu$m without any body bias voltage (Vbb). Each MAC unit occupied 100 $\mu$m×200 $\mu$m. Sixteen MAC units were included to provide larger currents for easier measurements.

FIG. 15 is a graph that shows the dependence of the ring oscillator frequency on the substrate bias voltage (Vbb). Several curves are presented, for several different supply voltage (Vdd) values. Forward bias generally reduces threshold voltage, and may thus improve circuit performance. As seen in the graph, small amounts of forward bias raise the oscillator frequency, but greater levels of bias may degrade performance.

The condition for minimum power operation in the demonstration circuit differs from that illustrated by the theoretical graph of FIG. 14A. First, forward diode current and parasitic-bipolar emitter current in the substrate are included in real, total power consumption. Second, excess forward bias can unexpectedly degrade circuit performance.

Figure 16:
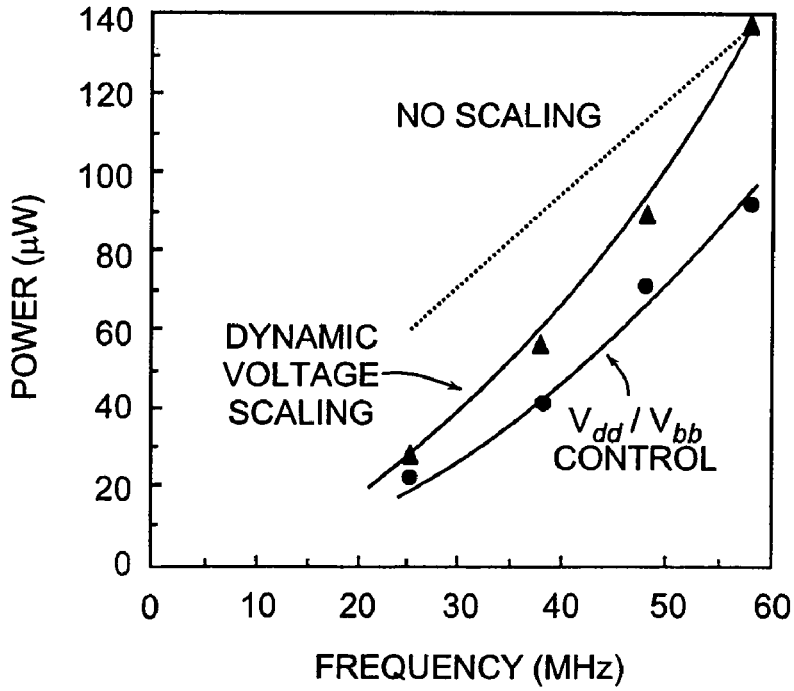
FIG. 16 is a graph that compares dynamic voltage scaling to adaptive substrate biasing for the digital signal processor corresponding to FIG. 15.

FIG. 16 is a graph that provides a comparison of dynamic voltage scaling to adaptive substrate biasing, with data obtained from the demonstration DSP core. A curve for a conventional device, i.e., one with no scaling, is shown for reference. The no scaling curve was obtained by extrapolation of operation of the DSP core at 50 MHz Dynamic voltage scaling generally reduces power in comparison to no scaling. Adaptive substrate biasing, which includes control of power consumption of the DSP core via selection, during operation, of preferred supply and substrate bias voltages, generally reduces power consumption in comparison to use of dynamic voltage scaling only.

The control of both supply and body bias voltages may enable dynamic optimization of the total operating power of a digital circuit for different operating conditions. The optimization may provide a balanced response to dynamic, subthreshold and forward bias parasitic currents. A CMOS circuit generally has a maximum forward bias range before encountering performance degradation because excess forward Vbb can weaken switching currents. With scaling to smaller device component dimensions and reduction of native threshold voltages, forward bias limitations may become less dominant.

While the invention has been shown and described with reference to specific preferred embodiments, it should be understood by those skilled in the art that various changes in form and detail may be made therein without departing from the spirit and scope of the invention as defined by the following claims.

What is claimed is:

1. A system for improving the power efficiency of an electronic device, the system comprising:

a threshold voltage selector that selects a value of a threshold voltage, for operation of the device at the selected value of the threshold voltage, in response to a present operating condition of the device detected during operation of the device; and a supply voltage selector that selects, in cooperation with the threshold voltage selector, a value of a supply voltage to be applied to the device in response to the present operating condition of the device, the threshold voltage and the supply voltage controlling a power consumption of the device, wherein the supply voltage selector cooperates with the threshold voltage selector by varying the supply voltage while the threshold voltage is fixed.

2. The system of claim 1 wherein the threshold voltage selector cooperates with the supply voltage selector by varying the threshold voltage while the supply voltage is fixed.

3. The system of claim 1 wherein the device comprises a plurality of PMOS and NMOS transistor pairs, and wherein the threshold voltage selector selects first and second values of the threshold voltage for the plurality of PMOS and the plurality of NMOS transistors to respectively operate at the first and second values, and the supply voltage selector selects first and second values of the supply voltage to be applied respectively to the plurality of PMOS and the plurality of NMOS transistors, the first value of the threshold voltage and the first value of the supply voltage controlling a power consumption of the plurality of PMOS transistors, and the second value of the threshold voltage and the second value of the supply voltage controlling a power consumption of the plurality of NMOS transistors.

4. The system of claim 3 wherein each one of the plurality of transistor pairs comprises a triple-well.

5. The system of claim 1 further comprising a threshold voltage circuit that controls the value of the threshold voltage of the device.

6. The system of claim 5 wherein the threshold voltage circuit controls the value of the threshold voltage by generating and applying a corresponding body bias voltage.

7. The system of claim 1 further comprising a supply voltage circuit that applies the value of the supply voltage to the device by generating the supply voltage.

8. The system of claim 1 further comprising a present operating condition detector that measures the present operating condition of the device.

9. The system of claim 1 wherein the device is a microprocessor.

10. The system of claim 1 wherein the threshold voltage selector comprises a threshold voltage control loop, and the supply voltage selector comprises a supply voltage control loop, which respectively enable selection of the value of the threshold voltage and the value of the supply voltage of the device in response to a measured power consumption of the device, during operation of the device.

11. The system of claim 10 wherein the threshold voltage control loop comprises a body bias control loop that controls a body bias voltage.

12. The system of claim 11 wherein the body bias control loop comprises an adaptive body bias controller.

13. The system of claim 1 further comprising a present operating condition detector, and wherein the threshold voltage selector comprises a threshold voltage control loop, and the supply voltage selector comprises a look up table comprising a plurality of operating condition values and a plurality of supply voltage values in a predetermined correspondence, the supply voltage selector selecting the value of the supply voltage from the look up table in correspondence to the present operating condition detected by the present operating condition detector, and the threshold voltage control loop determines the value of the threshold voltage during operation of the device.

14. The system of claim 11 wherein the present operating condition detector measures at least one operating condition parameter.

15. The system of claim 1 further comprising test monitor circuitry that approximates a behavior characteristic of the device.

16. The system of claim 15 wherein the test monitor circuitry approximates a switched capacitance to leakage width ratio of the device.

17. The system of claim 15 wherein the test monitor includes one or more switched inverters and one or more non-switched inverters; and wherein a ratio of the switched inverters to non-switched inverters approximates a switched capacitance to leakage width ratio of the device.

18. The system of claim 17 wherein at least one of the inverters is dynamically programmable to be either switched or non-switched.

19. The system of claim 1 further comprising an operating condition detector that detects the present value of the operating condition, and wherein the threshold voltage selector and the supply voltage selector comprise a look up table comprising a plurality of operating condition values of the device in correspondence with a plurality of supply voltage values and threshold voltage values, the present value of the supply voltage and the present value of the threshold voltage being selected from the look up table in correspondence to the present value of the operating condition.

20. The system of claim 1 further comprising an update trigger that causes the threshold voltage selector to select the present value of the threshold voltage and the supply voltage selector to select the present value of the supply voltage when the operating condition changes by a predetermined magnitude.

21. A method of controlling power consumed by an electronic device, comprising:

detecting a present operating condition of the device;

selecting a value of a threshold voltage, for operation of the device at the selected value of the threshold voltage, in response to the present operating condition of the device; and selecting a value of a supply voltage to be applied to the device, in cooperation with the selection of the value of the threshold voltage, in response to the present operating condition of the device, the threshold voltage and the supply voltage controlling a power consumption of the device, wherein selecting the value of the supply voltage comprises varying the supply voltage while the threshold voltage is fixed.

22. The method of claim 21 wherein selecting the value of the threshold voltage comprises varying the threshold voltage while the supply voltage is fixed.

23. The method of claim 21 further comprising: selecting a second value of a threshold voltage, for operation of the device at the selected second value of the threshold voltage, in response to the present operating condition; and selecting a second value of the supply voltage to be applied to the device in response to the present operating condition, the second value of the threshold voltage and the second value of the supply voltage for controlling a second power consumption of the device.

24. The method of claim 21 wherein detecting comprises determining a target frequency of the device.

25. The method of claim 21 wherein detecting comprises measuring at least one of a workload and a temperature of the device.

26. The method of claim 21 wherein detecting comprises determining the present operating condition from a monitor circuit.

27. The method of claim 21 wherein detecting comprises repeatedly measuring a value of the operating condition during operation of the device.

28. The method of claim 27 wherein repeatedly measuring comprises continuously measuring the present value of the operating condition.

29. The method of claim 27 wherein repeatedly measuring comprises periodically measuring the present value of the operating condition.

30. The method of claim 21 further comprising detecting the present operating condition, and wherein selecting the value of the supply voltage comprises selecting the value of the supply voltage that corresponds to the present operating condition from a look up table comprising a plurality of operating condition values and a plurality of supply voltage values in a predetermined correspondence, and selecting the value of the threshold voltage comprises varying a threshold voltage during operation of the device via a threshold voltage control loop, after selecting the value of the supply voltage.

31. The method of claim 30 wherein selecting the value of the threshold voltage comprises sweeping a threshold voltage to determine the power consumption of the device.

32. The method of claim 21 further comprising detecting the present operating condition, and wherein selecting the value of the threshold voltage comprises selecting the value of the threshold voltage that corresponds to the present operating condition from a look up table comprising a plurality of operating condition values and a plurality of threshold voltage values in a predetermined correspondence, and selecting the value of the supply voltage comprises varying a supply voltage during operation of the device, after selecting the value of the threshold voltage.

33. The method of claim 21 further comprising detecting the present value of the operating condition, and wherein selecting the threshold voltage and selecting the supply voltage comprise selecting the value of the threshold voltage and selecting the value of the supply voltage that correspond to the present operating condition from a look up table comprising a plurality of operating condition values of the device in predetermined correspondence with a plurality of supply voltage values and threshold voltage values.

34. The method of claim 21 wherein selecting the value of the threshold voltage comprises reselecting the value of the threshold voltage in response to a change in the value of the operating condition of at least a predetermined magnitude.

35. The method of claim 21 wherein selecting a value of a threshold voltage comprises repeatedly selecting a value of a threshold voltage and selecting a value of a supply voltage value comprises repeatedly selecting a value of the supply voltage, to control the power consumption of the device.

36. The method of claim 35 wherein repeatedly selecting the value of the threshold voltage comprises resetting a body bias voltage to a maximum forward body bias responsively to a change in a present supply voltage, and sweeping the body bias voltage.

37. The method of claim 35 wherein selecting the value of the supply voltage comprises stepping a controller of a supply voltage, and selecting the value of the threshold voltage comprises sweeping a body bias voltage to determine a preferred body bias voltage for each step of the controller of the supply voltage.

* * * * *